US007913666B2

(12) United States Patent
Achleitner et al.

(10) Patent No.: US 7,913,666 B2
(45) Date of Patent: Mar. 29, 2011

(54) METHOD AND DEVICE FOR CONTROLLING AN INJECTION VALVE OF AN INTERNAL COMBUSTION ENGINE

(75) Inventors: Erwin Achleitner, Obertraubling (DE); Thomas Maurer, Passau (DE); Carlos Eduardo Migueis, Tegernheim (DE)

(73) Assignee: Continental Automotive GmbH, Hannover (DE)

( * ) Notice: Subject to any disclaimer, the term of this patent is extended or adjusted under 35 U.S.C. 154(b) by 227 days.

(21) Appl. No.: 12/300,846

(22) PCT Filed: Mar. 2, 2007

(86) PCT No.: PCT/EP2007/051984

§ 371 (c)(1),
(2), (4) Date: Nov. 14, 2008

(87) PCT Pub. No.: WO2007/134887

PCT Pub. Date: Nov. 29, 2007

(65) Prior Publication Data

US 2009/0177366 A1 Jul. 9, 2009

(30) Foreign Application Priority Data

May 18, 2006 (DE) ..... 10 2006 023 468

(51) Int. Cl.
*F02M 1/00* (2006.01)

(52) U.S. Cl. ..... 123/447; 123/456; 123/457

(58) Field of Classification Search ..... 701/101, 701/107; 123/445, 446, 447, 454, 456, 457, 123/478, 480, 511

See application file for complete search history.

(56) References Cited

U.S. PATENT DOCUMENTS

| | | | | |
|---|---|---|---|---|
| 5,176,122 | A | 1/1993 | Ito | 123/478 |
| 5,801,308 | A | 9/1998 | Hara | 73/223 |
| 6,227,168 | B1 * | 5/2001 | Nishiyama | 123/456 |
| 6,463,910 | B2 * | 10/2002 | Nishiyama | 123/456 |
| 6,964,261 | B2 | 11/2005 | Warne et al. | 123/436 |
| 7,302,935 | B2 * | 12/2007 | Achleitner et al. | 123/446 |
| 7,328,689 | B2 * | 2/2008 | Achleitner et al. | 123/446 |
| 7,493,804 | B2 * | 2/2009 | Achleitner et al. | 73/114.41 |
| 7,607,417 | B2 * | 10/2009 | Achleitner et al. | 123/447 |
| 7,624,719 | B2 * | 12/2009 | Achleitner et al. | 123/456 |
| 2004/0011325 | A1 | 1/2004 | Benson et al. | 123/299 |

FOREIGN PATENT DOCUMENTS

| | | | |
|---|---|---|---|
| DE | 69112355 | T2 | 2/1996 |
| DE | 19726100 | A1 | 1/1998 |
| DE | 19738722 | A1 | 3/1999 |
| DE | 10261446 | A1 | 7/2004 |
| EP | 0905359 | A2 | 3/1999 |
| EP | 0940571 | A2 | 9/1999 |
| EP | 1541842 | A1 | 6/2005 |
| JP | 62186034 | A | 8/1987 |
| WO | 00/19090 | | 4/2000 |
| WO | 2004/104397 | A1 | 12/2004 |

* cited by examiner

*Primary Examiner* — John T Kwon
(74) *Attorney, Agent, or Firm* — King & Spalding L.L.P.

(57) ABSTRACT

In order to reduce the quantity deviation of a fuel injection valve, it is proposed according to the various embodiments that a test injection be carried out during an overrun cut-off phase of a motor vehicle in operation. In the process, the fuel rail (2) is closed on the inlet side and the selected injection valve (1) is activated. A quantity difference between the predetermined setpoint and the actual value can be determined by measuring a pressure difference in the fuel rail (2) before and after the test injection. This results in a correction factor with which the activation for the selected injection valve (1) is corrected for subsequent injections.

17 Claims, 2 Drawing Sheets

METHOD AND DEVICE FOR CONTROLLING AN INJECTION VALVE OF AN INTERNAL COMBUSTION ENGINE

CROSS-REFERENCE TO RELATED APPLICATIONS

This application is a U.S. National Stage Application of International Application No. PCT/EP2007/051984 filed Mar. 2, 2007, which designates the United States of America, and claims priority to German Application No. 10 2006 023 468.5 filed May 18, 2006, the contents of which are hereby incorporated by reference in their entirety.

TECHNICAL FIELD

The invention relates to a method or a device for controlling an injection valve of an internal combustion engine. During control of the injection valve a deviation between a predetermined setpoint value and an actual value of an amount of fuel injected into a combustion chamber of the internal combustion engine is compensated for.

BACKGROUND

It is already known that during the operation of the internal combustion engine the amount of fuel to be injected can be controlled by an appropriate actuation of the injection valve, for example through the valve lift of its injector needle, the opening time and/or the fuel pressure (rail pressure) in the injection system. However the real injected fuel amount (actual value) is still especially influenced by manufacturing tolerances and ageing influences of the injection valve. This produces deviations from the predetermined setpoint value, which especially with very small injection amounts, as are needed for example in a pre-injection or in a post-injection for heating up an exhaust gas catalytic converter are relatively large. It is especially disadvantageous that the deviation can be different for each individual injection valve.

To compensate for the deviation between the predetermined setpoint value and the actual value of the amount of fuel injected a method has already been proposed in which the uneven running of the internal combustion engine is evaluated. This method is used especially with diesel motors for zero set adaptation.

Furthermore an injection system, especially for a diesel engine, is known from US 2004/0011325 A1, in which the fuel is injected both in a main injection and also additionally in an auxiliary injection in the internal combustion engine. To calculate the amount of fuel for the supplementary injection the fuel pump is first switched on and through activation of the injection valve a fuel injection is generated and after a stabilization phase a first fuel pressure in the fuel rail is measured. Thereafter the injection valve is deactivated, the fuel pump switched off and a second fuel pressure in the fuel rail measured, before the pump is switched on again. From the two pressure values and taking into account the activation signal for the injection valve as well as further operating parameters, a control unit determines a mode, in accordance with which the fuel amount is determined for the supplementary injection. With this system the required fuel amount is designed to be adapted to the operating conditions of the internal combustion engine.

Furthermore a measuring device is known from DE 197 38 722 A1 which is used on an injection valve test bed, in order to measure the injection rate and amount of fuel injected.

With this method the pressure increase in a measurement volume is determined and the injected fuel amount is determined from this.

SUMMARY

The accuracy of an amount of fuel to be injected for a fuel injection system of an internal combustion engine can be improved. In this case the real injected fuel amount for at least one selected injection valve of the internal combustion engine is to be determined exactly, without adversely affecting the drive comfort by doing so.

According to an embodiment, a method for control of an injection valve, with a deviation between a predetermined setpoint value and an actual value of an amount of fuel injected into a combustion chamber of a internal combustion engine being compensated for, may comprise the step of injecting the fuel into the internal combustion engine with the aid of a number of injection valves of an injection system during the operation of a motor vehicle wherein the deviation between the predetermined setpoint value and the actual value of the amount of fuel injected being determined by detecting the drop in pressure in a fuel rail of the injection system by the following steps: —during un overrun cut-off phase, initiating a test phase in which a defined, stable status is initially set in the fuel rail, —after the stable status has been reached, determining a first pressure value in the fuel rail with a first pressure measurement, —subsequently selecting at least one injection valve which is activated for a test injection with a predetermined setpoint value, —after the test injection, determining a second pressure value with a second pressure measurement in the fuel rail, —computing a difference value from the determined two pressure values, and —determining a correction factor from the computed difference value, with which the activation of the selected injection valve is corrected, —wherein a very small amount of fuel is used for the test injection, and wherein the fuel amount corresponds to a fuel amount of a pre-injection or post-injection or of a heating injection for the catalytic converter.

According to a further embodiment, to set the stable status all injection valves can be deactivated and the fuel rail can be closed on the input side. According to a further embodiment, to set the stable status the fuel rail can be supplied with a defined leakage flow. According to a further embodiment, a limit value can be predetermined for the computed difference value and, if the predetermined limit value is exceeded, the correction factor is determined. According to a further embodiment, the difference value or the correction factor respectively can be determined for each injection valve individually. According to a further embodiment, the correction factor can be determined for each cylinder of the internal combustion engine. According to a further embodiment, the test injection can be undertaken during the compression phase. According to a further embodiment, the test injection can be undertaken during the expansion phase. According to a further embodiment, the amount of fuel to be injected during the test injection may correspond to that of a pre-injection, that of at least one of a post-injection and a heating injection for a catalytic converter. According to a further embodiment, the compensation for the amount of fuel injected can be undertaken for a diesel or a gasoline engine.

According to another embodiment, in an apparatus for controlling of an injection valve, with a fuel rail of an injection system for an internal combustion engine, with a pressure sensor, which is arranged on the fuel rail for measuring the fuel pressure and with a control unit, the control unit is operable, during an overrun cut-off phase of the motor vehicle, to set a controlled status in the fuel rail, then for a test injection to activate an individual injection valve for injection of a predetermined fuel amount, to determine a pressure difference in the fuel rail and to determine therefrom a correction factor for adaptation of the actual value for the injected fuel amount for the tested injection valve, wherein—the device is operable to use a very small amount of fuel for the test injection, —and wherein the fuel amount corresponds to that of a pre-injection or post-injection or to that of a heating injection for the catalytic converter.

According to a further embodiment, the device may be operable for a common rail injection system for a diesel or gasoline engine.

BRIEF DESCRIPTION OF THE DRAWINGS

An exemplary embodiment of the invention is shown in the drawing and will be explained in greater detail in the description given below.

DETAILED DESCRIPTION

Figure 1:
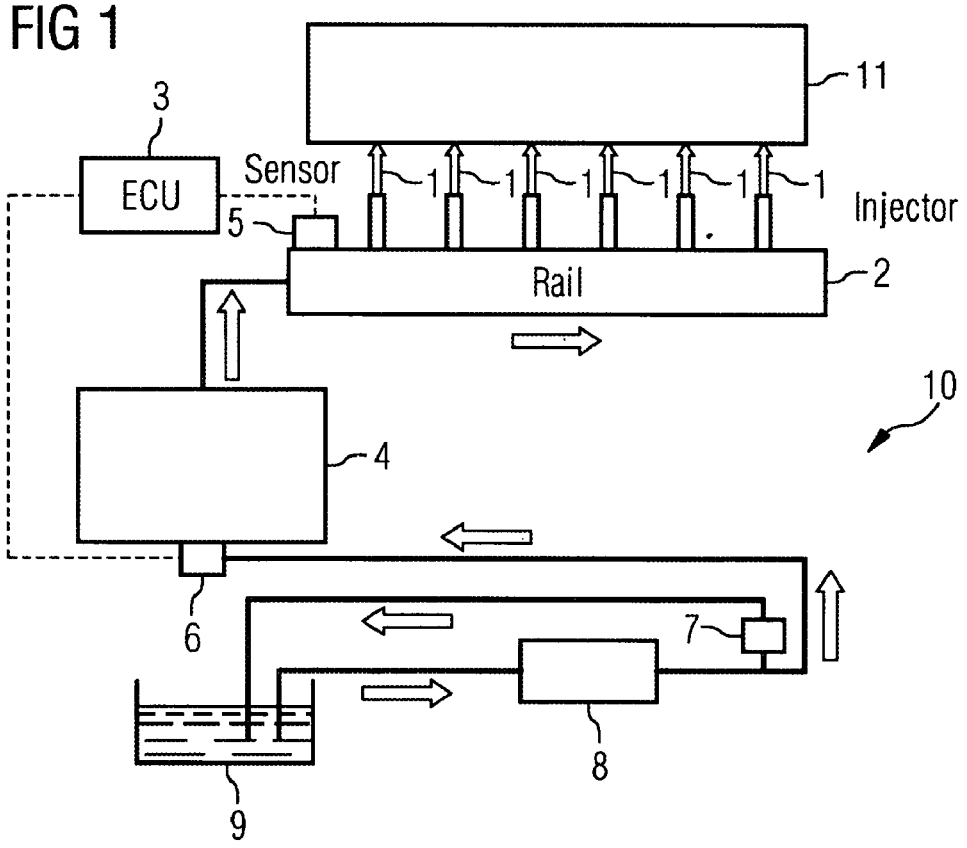
FIG. 1 shows a schematic diagram of a device according to an embodiment which is shown as a block diagram.

In the method or device respectively according to various embodiments for control of an injection valve, in which a deviation between a predetermined setpoint value and an actual value of an amount of fuel injected into a combustion chamber of an internal combustion engine is adapted according to a generic model, the advantage emerges that for each individual injection valve of the internal combustion engine an injection amount is injected which corresponds to the predetermined setpoint value or at least gets very close to the predetermined setpoint value.

Deviations between the predetermined setpoint value and the actual value, which are inevitable especially as a result of production tolerances in the manufacturing of the injection valve and/or also through ageing and wear during the operating life of the injection valve are automatically compensated for by the various embodiments. In this way an equally good optimum fuel injection is always achieved during the operating life of the internal combustion engine or of the motor vehicle, which is minimal as regards fuel injection, favorable emission values are created and an optimum efficiency of the internal combustion engine is produced. In such cases it is seen as advantageous that for each injection valve during its entire lifetime especially the smallest amounts of fuel are injected with the greatest accuracy since possible deviations will be compensated for automatically. It is further of advantage that the effectiveness of the catalytic converter is also improved, since for its post injection to maintain its operating temperature the required fuel amount can be metered very precisely. A further aspect of the various embodiment is also that the warm-up time of the exhaust gas catalytic converter is effectively shortened, so that the statutory limit values for the emission values can be safely adhered to.

A simple option for setting the stable status in the fuel rail is obtained if the injection valves connected to the fuel rail are deactivated and the fuel rail is closed on the input side.

An alternate option for setting the stable status for the fuel rail also lies in that fact that the fuel rail is supplied with a defined leakage flow by the high-pressure fuel pump. In this case the leakage flow is kept constant so that the pressure of the fuel contained in the fuel rail can be measured very easily.

It is additionally of advantage that a limit value is specified for the computed difference value between the setpoint value and the actual value. This limit value is preferably defined for an ideal injection valve, in which no manufacturing tolerances and/or ageing influences occur. Only when the predetermined limit value is exceeded will the correction factor be determined which is then used for adapting the further control of the injection valve. A further result achieved by predetermining the limit value is that the smallest deviations between the setpoint value and the actual value do not lead to a change in the valve activation, since they might possibly depend on measurements.

In order to optimize the fuel injection for each injection valve individually, there is provision according to various embodiments for the correction factor to be applied sequentially and individually for all available injection valves of the injection system or for all cylinders of the internal combustion engine. The individual adaptation of the individual injection valves enables the fuel combustion in the internal combustion engine to be controlled optimally and permanently.

Since only a small amount of fuel is needed for the test injection, there is provision for the test injection to be undertaken during the compression phase of the internal combustion engine. Since the test injection occurs especially in the overrun mode, there is no negative effect on the even running of the internal combustion engine.

Alternatively a test injection can be performed during the expansion phase of the internal combustion engine. In this case the test injection likewise does not have any negative effect on the even running of the internal combustion engine or even adversely influence the overrun mode.

There is further provision according to various embodiments for the fuel amount to be injected in the test injection to be very small. The fuel amount can for example correspond to that of a pre-injection or post-injection or that of a warming-up injection for the catalytic converter.

FIG. 1 shows a schematic diagram of a device according to various embodiments, with which during injection of fuel into an internal combustion engine a deviation between a predetermined setpoint value and a real actual value can be compensated for. The apparatus 10 shown in FIG. 1 features an injection system which is embodied as a common-rail injection system for example. A major component of the injection system is a fuel rail 2 which is connected via high-pressure lines to the corresponding injection valve 1. The injection valves 1 are built into a cylinder head of an internal combustion engine 11, in order to inject an appropriate amount of fuel into the individual cylinders of the internal combustion engine 1. As can further be seen from FIG. 1, six injection valves 1 are arranged on the internal combustion engine 11. As a rule one injection valve 1 is provided for each cylinder of the internal combustion engine 11, so that six injection valves 1 are needed for a six-cylinder engine. Each injection valve 1 is for example embodied with a piezoelectric actuator so as to be able to control very short and rapid injection pulses, as are especially also needed for multiple injection. The injection valves 1 are activated by a correspondingly embodied engine management device (not shown in FIG. 1) as a function of the operating conditions of the internal combustion engine 11.

The fuel rail is hydraulically connected via a high-pressure line filled with fuel to a high-pressure pump 4. The direction of flow of the fuel is indicated by corresponding arrows. The high-pressure pump 4 is for example embodied as a single-piston pump or as a multi-piston pump with a volume flow control valve. A defined leakage flow can be set by the volume flow control valve which supplies the fuel rail 4 with fuel at high pressure. The high-pressure pump 4 is connected on the input side via corresponding lines to a fuel tank 9. The fuel tank 9 is filled with diesel oil or gasoline. Switched into the connecting line to the high-pressure pump 4 is a low-pressure pump 8. The low-pressure pump 8 is connected on its output side to a pressure regulator 7, through which superfluous fuel can be routed back via a further fuel line into the fuel tank 9.

On the input side the high-pressure pump 4 is further connected to a PWM valve 6 with which the flow of fuel can be controlled. This PWM valve 6 is controlled by a control unit 3, in accordance with the pulse width modulation method for example. The control unit 3 has a processing unit which can be controlled by a corresponding program. The control unit 3 is also connected electrically to a pressure sensor 5 which is fitted to the fuel rail 2 and measures the fuel pressure within the fuel rail 2.

In an alternate embodiment there is provision for a temperature sensor to be arranged on the fuel rail 2 which measures the fuel temperature and from which measured values will likewise be transmitted to the control unit 3.

In addition the PWM valve 6 can be closed by the control unit 3, so that the fuel rail 2 is closed off or alternatively supplied with fuel with a predetermined leakage flow.

The functioning of the device according to various embodiments and in accordance with FIG. 1 will be explained in greater detail with reference to the subsequent figures.

One aspect of the various embodiments is that, for at least one, preferably for each individual injection valve 1, a correction value is determined with which the activation of the injection valve 1 is adapted, in order to achieve the setpoint value predetermined for the fuel amount injection as precisely as possible. The predetermined setpoint value for the fuel amount to be injected is for example computed or determined by an engine management device as a function of a number of engine parameters. For example the speed, the temperature, the gas pedal setting, the gear selected etc. are taken into consideration. The engine management device extracts one or more values for a required fuel injection, taking into account the received parameter data, from a previously stored database or table. To this end the injection valves 1 are activated with one or more suitable control pulses in order to achieve the predetermined setpoint value for the fuel amount to be injected.

In practice however it has been shown that the actual injected fuel amount (actual value) deviations more or less strongly from the predetermined setpoint value. The reason for this phenomenon could be manufacturing tolerances for example which arise during the manufacturing of the injection valve and are not completely avoidable. Wear or ageing, which over the course of the service life of the injection valve can lead to a changed injection behavior, can be a further cause. In order to compensate for deviations from the predetermined setpoint value of the actual amount of fuel injected, it is proposed according to various embodiments that a test injection initially be used to determine how great the deviation between the setpoint value and the actual value actually is. This test injection is preferably undertaken individually for each injection valve or for each cylinder of the internal combustion engine 11.

Figure 2:
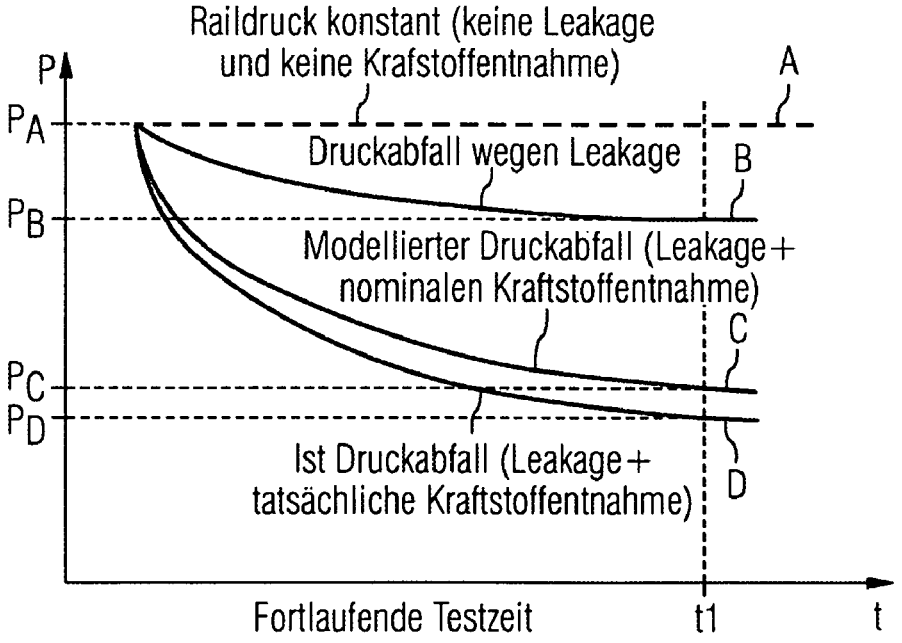
FIG. 2 shows a diagram with pressure curves and FIG. 3 shows a flow diagram.

FIG. 2 shows a diagram with different pressure curves, which will be used to explain in greater detail the problem outlined above. FIG. 2 shows the fuel pressure P in the fuel rail 2 on the Y-axis. The ongoing test time is plotted on the X-axis.

Ideal conditions would obtain if no leakage occurs at a high rail pressure in the fuel rail. It is assumed that the fuel rail is closed on the input side. Furthermore all injection valves are closed, so that there is neither an inflow nor a withdrawal of fuel. In this case the fuel pressure $P_A$ in the fuel rail is constant. This status is reflected by the dashed-line curve labeled A running horizontally in the diagram. For example the pressure value $P_A$ is measured at time t1.

In practice however, because of an inevitable leakage, a drop in pressure in the fuel rail 2 is present, so that the rail pressure (fuel pressure) P reduces over time. The corresponding pressure characteristic is reproduced by curve B. For example at time t1 the pressure value $P_B$ is obtained which is lower than the pressure value $P_A$.

With curve C the starting point is again the initial pressure $P_A$, when the fuel rail is filled and closed on the input side. Using a model calculation in a test phase, a simulated activation of an individual injection valve with a test injection is now undertaken, in which for a specific time a predetermined fuel amount is injected as setpoint value into the combustion chamber of the internal combustion engine. The ongoing withdrawal of fuel produces in the fuel rail a pressure characteristic as represented by curve C. Curve C also takes account in this case of the drop in pressure caused by the leakage. It is further assumed that all further injection valves are closed. When a defined status is reached, for example at point in time t1, a modeled fuel pressure is thus produced, which is stored as the first pressure value $P_C$. The first pressure value $P_C$ thus corresponds to the predetermined setpoint value when the defined, stable status in the fuel rail is reached.

Curve D represents the case in which a real injection valve is used which was manufactured with a corresponding manufacturing tolerance and/or which exhibits a changed injection behavior as a result of ageing and wear. Curve D thus corresponds—likewise taking into account the leakage—to the real actual value for the injected fuel amount. A lower fuel pressure P obtains in the fuel rail than that shown by the curve C. At time t1 the fuel pressure has the pressure value $P_D$. This means that there is a greater fuel outflow in the fuel rail and thus the actual value is greater than the predetermined setpoint value $P_C$ of the curve C. Thus the injection valve has injected a greater fuel amount into the internal combustion engine and has thereby exceeded the predetermined required value. Consequently, for a subsequent injection, the selected injection valve is to be activated with the determined correction factor in a manner in which the injection valve injects less fuel in order to reach the fuel amount predetermined by the setpoint value or to at least get quite close to it.

There is thus provision to compensate for the deviation of the actual amount of fuel injected (actual value) from the predetermined required value which is determined from the pressure difference $P_D - P_C$ of the two curves C and D according to various embodiments. Thus a correction factor is determined, with which the activation for the injection valve corresponding to the above example is adapted by shortening the injection time of the relevant injection valve, through a reduced opening width of the injector needle of the injection valve and/or by a drop in pressure in the fuel rail.

Otherwise, if the actual value is less than the setpoint value, a corresponding negative correction factor is produced. This means that the activation for the injection valve is modified in a way which lengthens the injection time, increases the opening width of the injector needle and/or increases the rail pressure. The correction factor can in this case for example be used as a percentage or as a constant.

In an alternate embodiment there is provision for a minimal deviation between the setpoint value and the actual value, which would not be relevant for example with a larger injection amount or would be caused by measurement tolerances during the pressure measurement, not to be compensated for.

For minimal deviations a limit value is thus predetermined, so that a compensation is only undertaken for the injection amount if the predetermined limit value is exceeded.

The description below explains the algorithm with which the activation of the injection valve is compensated for. During an overrun cut-off phase of a motor vehicle a test phase is initiated in which the test injection is performed. If the overrun cut-off phase is detected, a defined status is set in the test phase in the fuel rail. For example the fuel rail is closed with the aid of the PWM valve 6, so that no more fuel is supplied.

Alternatively there is provision, with a high-pressure pump with a volume flow control valve, to embody a defined leakage flow in the fuel rail. The volume flow can for example be measured with a method which was proposed in WO 2004/104397A1.

After a stable status has been reached in the fuel rail, an individual injection valve is activated for a defined time in order to inject the predetermined fuel amount (setpoint value). The continuous withdrawal of fuel of the activated injection valve causes a drop in pressure in the fuel rail. With a high-pressure pump with a volume control valve however a slow increase in pressure can also occur.

Mathematically the method in accordance with various embodiments can be resolved with the following algorithm. The fuel amount $Q_{rail}$ withdrawn from the fuel rail is determined by the injected fuel amount $q_{injector}$ and the possible leakage component $q_{leakage}$. The injected fuel amount can again be nominally determined with the aid of the throughflow amount set (i.e. the predetermined setpoint value) $q_{injector\ nominal}$ and the possible deviation $q_{injector\ deviation}$ from the nominal throughflow amount, so that overall the following formula is produced:

$$Q_{rail}=q_{injector\ nominal}+q_{injector\ deviation}+q_{leakage} \quad (1)$$

The leakage component is determined by the drop in pressure in the fuel rail in a phase in which fuel is neither supplied nor withdrawn. From the known relationship between the volume and the pressure the withdrawn fuel amount $Q_{rail}$ can be computed as follows:

$$Q_{rail}=V_{rail}/K*\Delta P \quad (2)$$

$V_{rail}$ is the fuel volume in the fuel rail. This is a system parameter. K is coefficient of volume expansion, i.e. a fuel characteristic, which is dependent on the fuel temperature and with a longer test duration is to be regarded as variable. $\Delta P$ is drop in pressure which is measured after a predetermined test duration.

Equations (1) and (2) then produce $$Q_{injector\ deviation}=V_{rail}/K*\Delta P-q_{injector\ nominal}-q_{leakage} \quad (3)$$

The amount deviation $q_{injector\ deviation}$ determined in this way is taken into account for an activation for subsequent injections with this injection valve for compensation or for correction.

There is provision for applying the above algorithm for each injection valve and/or for each cylinder, in order, for each injection valve or for each cylinder respectively, to compensate for the deviation between the injection amount and the predetermined setpoint amount. This enables the method to be adapted to individual manufacturing tolerances and/or the ageing of the individual injection valves in a very simple and advantageous manner.

Also of importance to the various embodiments is that the test injection is undertaken in the overrun cut-off phase, so that the test injection does not cause any perceptible adverse affects on the running of the engine or drive comfort. In an alternate embodiment there is provision for the test injection to be conducted during the compression phase or during the expansion phase of the internal combustion engine.

Figure 3:
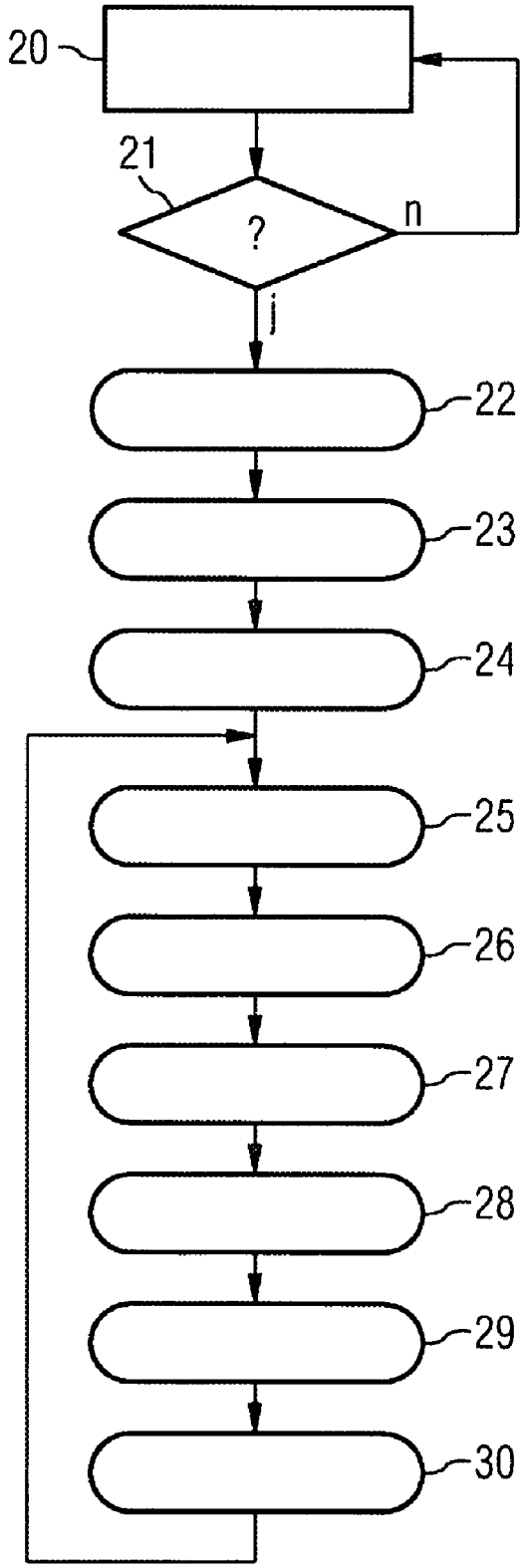

The execution of the method is explained in more detail with reference to the flowchart shown in FIG. 3. In item 20 the program starts with the corresponding resetting of the memory. In item 21 a query is made as to whether the overrun cut-off operating status has been reached. If it has not, the program branches back to item 20. If it has, if an overrun cut-off has been detected, in item 22 a defined, stable status of the fuel rail is set. This can be done for example by the fuel supply to the fuel rail being interrupted. Furthermore the injection valves are in the non-activated status. In item 23 the program starts with the test phase as soon as the stable status has been established. In item 24 a first fuel measurement in the fuel rail is undertaken. The first pressure value is preferably buffered. In item 25 an individual injection valve, for example the first injection valve, is selected. In item 26 the first injection valve is activated with a test pulse, while all remaining injection valves remain deactivated. The test pulse is designed, so that a fuel amount predetermined as a setpoint value can be injected into the corresponding cylinder of the internal combustion engine. The fuel amount is preferably very small and corresponds for example to that of a pre-injection or post-injection in a multiple injection or a heating injection for a catalytic converter.

The fuel injection causes fuel to be withdrawn from the fuel rail, so that now a second pressure measurement is performed and the second pressure value can be buffered (item 27). In item 28 the amount of fuel actually injected or the actual value for the fuel amount is calculated In item 29 the difference between the predetermined setpoint value and the actual value is computed. The deviation produces a correction value with which the activation of the first injection valve is adapted correspondingly for the next injections. This correction value is stored in item 30 for the first injector, so that the next injections will be automatically corrected. The program then branches back to item 25 and starts the test phase with the selection of the next individual injection valve.

There is provision for the program to be repeated with the test phase for the individual injection valves at cyclic intervals, so that both short-term effects and long-term effects are automatically able to be corrected.

What is claimed is:

1. A method for control of an injection valve, with a deviation between a predetermined setpoint value and an actual value of an amount of fuel injected into a combustion chamber of a internal combustion engine being compensated for, the method comprising the step of:

injecting the fuel into the internal combustion engine with the aid of a number of injection valves of an injection system during the operation of a motor vehicle wherein the deviation between the predetermined setpoint value and the actual value of the amount of fuel injected being determined by detecting a drop in pressure in a fuel rail of the injection system by the steps of:

during an overrun cut-off phase, initiating a test phase in which a defined, stable status is initially set in the fuel rail, after the stable status has been reached, determining a first pressure value in the fuel rail with a first pressure measurement, determining a leakage flow value based on the first pressure measurement, using a model to calculate a modeled pressure value resulting from a simulated test injection with a predetermined setpoint value, the calculated modeled pressure value accounting for the determined leakage flow value, subsequently selecting at least one injection valve which is activated for the test injection with the predetermined setpoint value, after the test injection, determining a second pressure value with a second pressure measurement in the fuel rail, computing a difference value between the calculated modeled pressure value and the determined second pressure value, and determining a correction factor from the computed difference value between the calculated modeled pressure value and the determined second pressure value, with which the activation of the selected injection valve is corrected.

2. The method according to claim 1, wherein, to set the stable status all injection valves are deactivated and the fuel rail is closed on the input side.

3. The method according to claim 1, wherein a limit value is predetermined for the computed difference value and that, if the predetermined limit value is exceeded, the correction factor is determined.

4. The method according to claim 1, wherein the difference value or the correction factor respectively is determined for each injection valve individually.

5. The method according to claim 4, wherein the correction factor is determined for each cylinder of the internal combustion engine.

6. The method according to claim 1, wherein the test injection is undertaken during the compression phase.

7. The method according to claim 1, wherein the test injection is undertaken during the expansion phase.

8. The method according to claim 1, wherein the amount of fuel to be injected during the test injection corresponds to that of at least a pre-injection, a post-injection and a heating injection for a catalytic converter.

9. The method according to claim 1, wherein the compensation for the amount of fuel injected is undertaken for a diesel or a gasoline engine.

10. An apparatus for controlling an injection valve in a system including a fuel rail of an injection system for an internal combustion engine, with a pressure sensor, which is arranged on the fuel rail for measuring the fuel pressure and with a control unit, with the control unit being operable to:

during an overrun cut-off phase, initiate a test phase in which a defined, stable status is initially set in the fuel rail, after the stable status has been reached, determine a first pressure value in the fuel rail with a first pressure measurement, determine a leakage flow value based on the first pressure measurement, use a model to calculate a modeled pressure value resulting from a simulated test injection with a predetermined setpoint value, the calculated modeled pressure value accounting for the determined leakage flow value, subsequently select at least one injection valve which is activated for the test injection with the predetermined setpoint value, after the test injection, determine a second pressure value with a second pressure measurement in the fuel rail, compute a difference value between the calculated modeled pressure value and the determined second pressure value, and determine a correction factor from the computed difference value between the calculated modeled pressure value and the determined second pressure value, with which the activation of the selected injection valve is corrected.

11. The device according to claim 10, wherein is operable for a common rail injection system for a diesel or gasoline engine.

12. The device according to claim 10, wherein to set the stable status the device is operable to deactivate all injection valves and to close the fuel rail on the input side.

13. The device according to claim 10, wherein the device is operable to predetermine a limit value for the computed difference value and, if the predetermined limit value is exceeded, to determine the correction factor.

14. The device according to claim 10, wherein the device is operable to determine the difference value or the correction factor, respectively for each injection valve individually.

15. The device according to claim 14, wherein the correction factor is determined for each cylinder of the internal combustion engine.

16. The device according to claim 10, wherein the test injection is undertaken during the compression phase.

17. The device according to claim 10, wherein the test injection is undertaken during the expansion phase.

* * * * *